United States Patent [19]

Kaufmann

[11] 4,106,529

[45] Aug. 15, 1978

[54] HEDDLE FRAME

[75] Inventor: Frank H. Kaufmann, Greenville, S.C.

[73] Assignee: Steel Heddle Manufacturing Company, Greenville, S.C.

[21] Appl. No.: 734,823

[22] Filed: Oct. 22, 1976

[51] Int. Cl.[2] ..... D03C 9/06

[52] U.S. Cl. ..... 139/92

[58] Field of Search ..... 139/91, 92, 82

[56] References Cited

U.S. PATENT DOCUMENTS

| | | | |
|---|---|---|---|
| 2,482,149 | 9/1949 | Blickenstorfer | 139/92 |
| 3,754,577 | 8/1973 | Heller | 139/92 |
| 3,895,655 | 7/1975 | Sujdak et al. | 139/92 |

FOREIGN PATENT DOCUMENTS

| | | | |
|---|---|---|---|
| 2,018,050 | 5/1970 | France | 139/91 |
| 6,911,347 | 1/1971 | Netherlands | 139/91 |
| 525,305 | 8/1972 | Switzerland | 139/91 |
| 1,308,326 | 2/1973 | United Kingdom | 139/92 |

*Primary Examiner*—James Kee Chi

*Attorney, Agent, or Firm*—Z. T. Wobensmith, III; Z. T. Wobensmith, 2nd

[57] ABSTRACT

Heddle frames are disclosed having heddle supporting rods with provisions to resist impact and for reduction of wear and abrasion and for noise reduction, this being accomplished by using a heddle rod with synthetic plastic material at the impact and wear surfaces or a heddle rod of such synthetic plastic material. The heddle rods in long frames may be supported intermediate their ends, and the heddles have C-shaped end eyes or closed end eyes depending upon the requirements of the particular installation.

5 Claims, 12 Drawing Figures

HEDDLE FRAME

BACKGROUND OF THE INVENTION

1. Field of the Invention

This invention relates to heddle frames and more particularly to improvements in heddle supporting rods used in such frames.

2. Description of the Prior Art

It has heretofore been common in the weaving art to employ heddle frames having rods on which the heddles are mounted. These rods have usually been made of steel strips of a cross section which facilitates mounting in the frame and on which the heddles are freely movable. One illustration of such rods is in the U.S. Pat. No. 3,417,788 to C. F. Kramer.

The vertical movement of the heddle frames in shedding and the inertia effect of the heddles at the ends of each cyclic movement results in impact stresses in the heddles and on the heddle rods with resultant noise and wear.

The horizontal movement of the heddles on the heddle rods also has an abrasive effect with attendant wear.

No satisfactory provisions have heretofore been made to reduce noise and wear where the end eyes of the heddles and the heddle rods engage.

SUMMARY OF THE INVENTION

In accordance with the invention a heddle frame is provided in which the portions of the heddle supporting rods at the locations of contact by the end eyes of the heddles are of a material to resist impact and for reduction of wear and abrasion and for noise reduction.

It is the principal object of the invention to provide a heddle frame in which the effects of impact of the heddles on their supporting bars are reduced, and the effects of wear and abrasion are reduced, so that the noise is reduced and the life of the heddle rods and heddles is lengthened.

It is a further object of the invention to provide heddle rods for supporting heddles which will improve the weaving operation.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
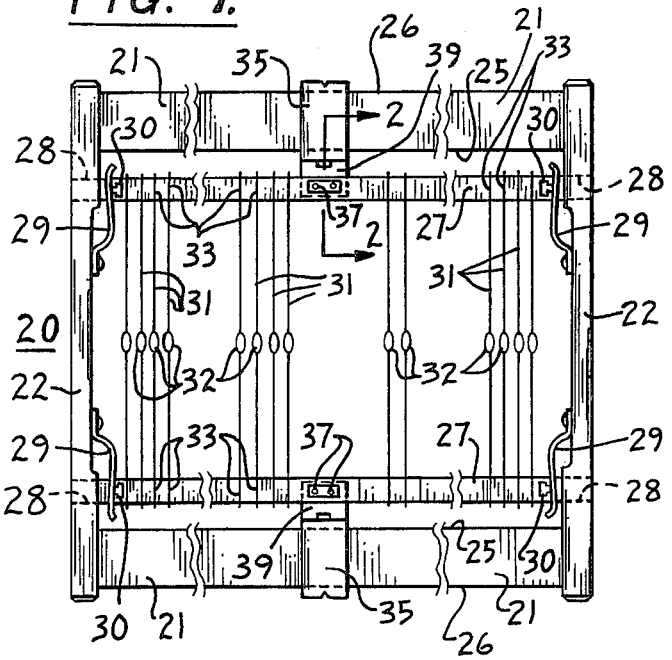
FIG. 1 is a front elevational view of a portion of a heddle frame having heddle rods in accordance with the present invention incorporated therein.
Figure 2:
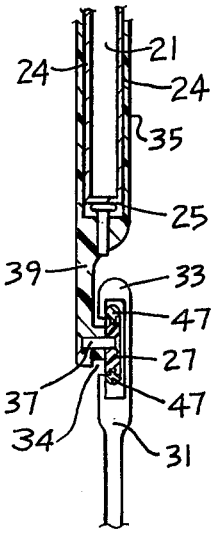
FIG. 2 is a vertical sectional view, enlarged, taken approximately on the line 2—2 of FIG. 1.
Figure 3:
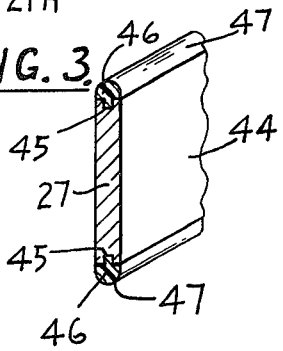
FIG. 3 is a fragmentary perspective view showing the heddle rod of FIGS. 1 and 2.

Referring now more particularly to FIGS. 1, 2 and 3 of the drawings, a heddle frame 20 is shown of well known construction comprising top and bottom rails 21 and side struts 22 connecting the ends of the rails 21 and maintaining them in spaced parallel relation. The side struts 22 can be held in engagement with the rails 10 in any desired manner, such as by screws (not shown).

The rails 21 are advantageously made of flattened steel tubing or of light weight metal alloys, such as those of aluminum or magnesium, with opposite parallel side faces 24 and opposite inner and outer faces 25 and 26.

The heddle frame 20 is shown as having mounted thereon upper and lower heddle supporting rods 27 and which may have their ends extending into openings 28 in the side struts 22, and held in place by spring clips 29 engaging in T-shaped apertures 30 in the rods 27. The heddle supporting rods 27 support a plurality of heddles 31 having central warp eyes 32 for controlling the shed and end eyes 33, one of the side shanks of which is cut away as at 34 to permit the heddles 31 to pass freely from end to end when the heddles 31 are supported in the heddle frame 20. The formation of the end eyes 32 for this purpose is shown in U.S. Pat. No. 2,047,511 and 2,386,690.

The heddle supporting rods 27 can be supported intermediate their ends, in any desired manner, such as by rail attachments 35 disposed in surrounding relation to the rails 21, and of a type such as shown in the U.S. Pat. No. 3,417,788 to Kramer, and with rivets 37 holding the rods 27 to the rail attachments 35.

The heddle supporting rods 27 in accordance with the invention as shown in FIGS. 1, 2 and 3, are preferably made as metal extrusions, include vertical portions 44 with their upper and lower margins having slots 45 for the reception and retention by friction of inserts 46 with curved outer faces 47.

The inserts 46 are preferably of synthetic plastic material which is resistant to impact, wear and abrasion and has a low coefficient of friction with respect to the inner portions of the end eyes 33 in engagement therewith during use.

Suitable materials include thermoplastics such as nylon, urethane and polyester.

The vertical portions 44 of the rods 27 can be supported in any desired manner, a preferred support being provided by the rivets 37 engaging the rods 27 and vertical flanges 39 of the attachments 25.

Figure 4:
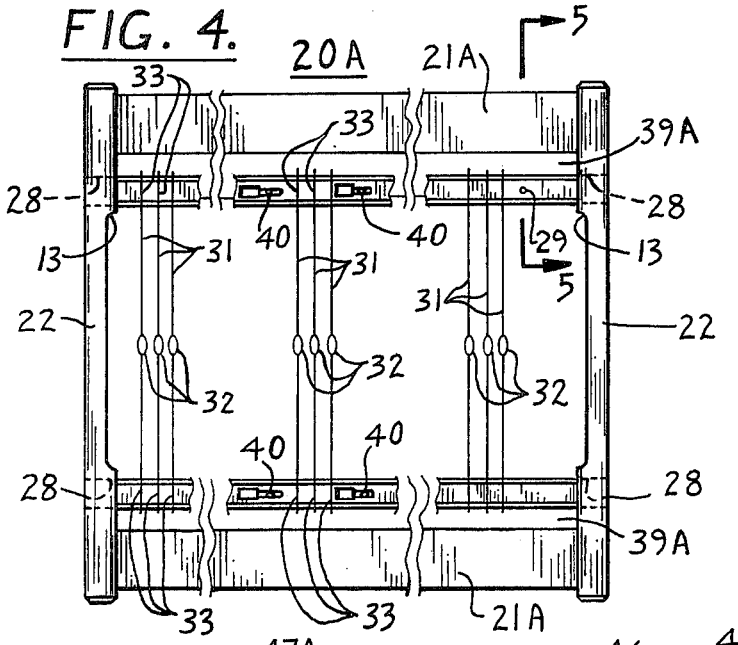
FIG. 4 is a front elevational view of another heddle frame having heddle rods in accordance with the invention incorporated therein.
Figure 5:
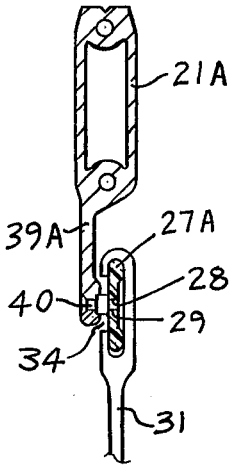
FIG. 5 is a vertical sectional view, enlarged, taken approximately on the line 5—5 of FIG. 4.
Figure 6:
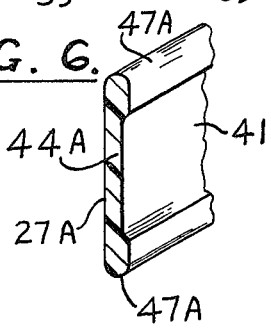
FIG. 6 is a fragmentary perspective view showing the heddle rods of FIGS. 4 and 5.

Referring now more particularly to FIGS. 4, 5, and 6 of the drawings, a heddle frame 20A is shown of well known construction and described in U.S. Pat. No. 3,362,437 to F. H. Kaufmann, comprising top and bottom rails 21A formed as metal extrusions and side struts 22 connecting the ends of the rails 21A and maintaining them in spaced parallel relation. The side struts 22 can be held in engagement with the rails 20A in any desired manner, such as by screws (not shown).

The rails 21A are advantageously made of light weight metal alloys, such as those of aluminum or magnesium, and with ribs 39A.

The heddle frame 20A is shown as having mounted thereon upper and lower heddle supporting rods 27A and which may have their ends extending into openings 28 in the side struts 22, and detachably held in place as shown in U.S. Pat. No. 3,362,437. The heddle supporting rods 27A support a plurality of heddles 31 having central warp eyes 32 for controlling the shed and end eyes 33 as previously described.

The heddle supporting rods 27A as shown in FIGS. 4, 5, and 6 preferably include vertical portions 44A with curved outer faces 47A and may include central grooves 41 along one side face for the reception of rivets 40. The rods 27A are preferably of synthetic plastic material which is resistant to impact, wear and abrasion and which has a low coefficient of friction with respect to the inner portions of the end eyes 33 in engagement therewith during use.

Suitable material include thermoplastics such as nylon, urethane and polyester, the rods 27A being molded or extruded.

Figure 7:
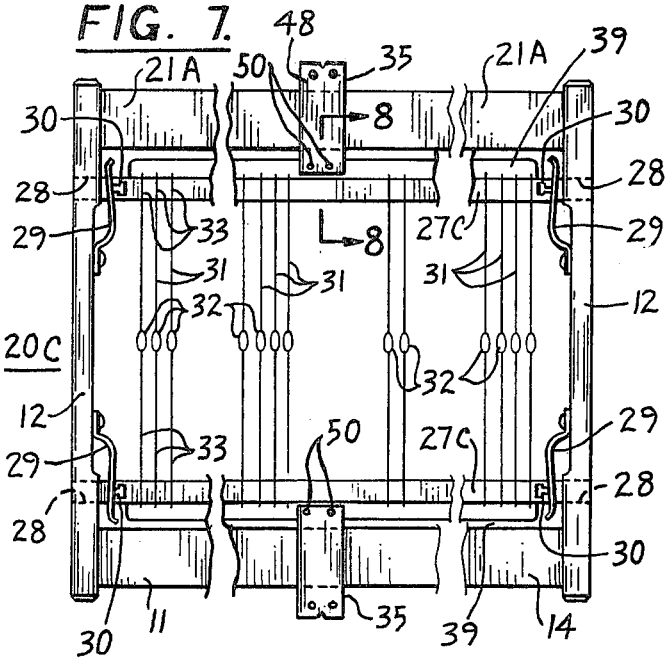
FIG. 7 is a front elevational view of a portion of another heddle frame having heddle rods in accordance with the invention incorporated therein.
Figure 8:
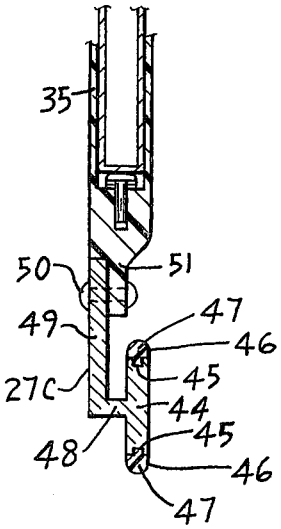
FIG. 8 is a vertical sectional view, enlarged, taken approximately on the line 8—8 of FIG. 7.
Figure 9:
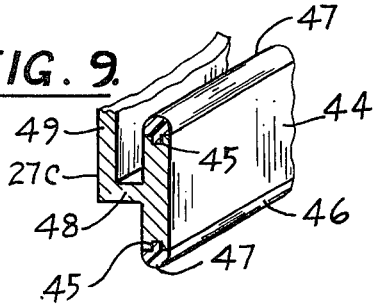
FIG. 9 is a fragmentary perspective view showing the heddle rods of FIGS. 7 and 8.

Referring now more particularly to FIGS. 7, 8, and 9 of the drawings, a heddle frame 20C is shown similar to that of FIGS. 1 and 2 and comprising top and bottom rails 21 and side struts 22.

The heddle frame 20C is shown as having mounted thereon upper and lower heddle supporting rods 27C and which may have their ends extending into openings 28 in the side struts 22, and held in place by spring clips 29 engaging in T-shaped apertures 30 in the rods 27C. The heddle supporting rods 27C support a plurality of heddles 31 similar to those previously described.

The heddle supporting rods 27C can be supported intermediate their ends, in any desired manner, such as by rail attachments 35 disposed in surrounding relation to the rails 21, as previously described.

The heddle supporting rods 27C as shown in FIGS. 7, 8, and 9, preferably made as metal extrusions, include vertical portions 44 with their upper and lower margins having slots 45 for the reception and retention by friction of inserts 46 with curved outer faces 47.

The inserts 46 are preferably of synthetic plastic material which is resistant to impact, wear and abrasion and has a low coefficient of friction of the inner portions of the end eyes 33, in engagement therewith during use.

Suitable materials include thermoplastics such as nylon, urethane and polyester.

The vertical portions 44 of the rods 27C can be supported in any desired manner, a preferred support being provided by integral offset ribs 48 from which vertical flanges 49 extend. The flanges 49 are shown as connected to the attachments 35 by rivets 50 extending through flanges 51 on the attachments 35.

Figure 10:
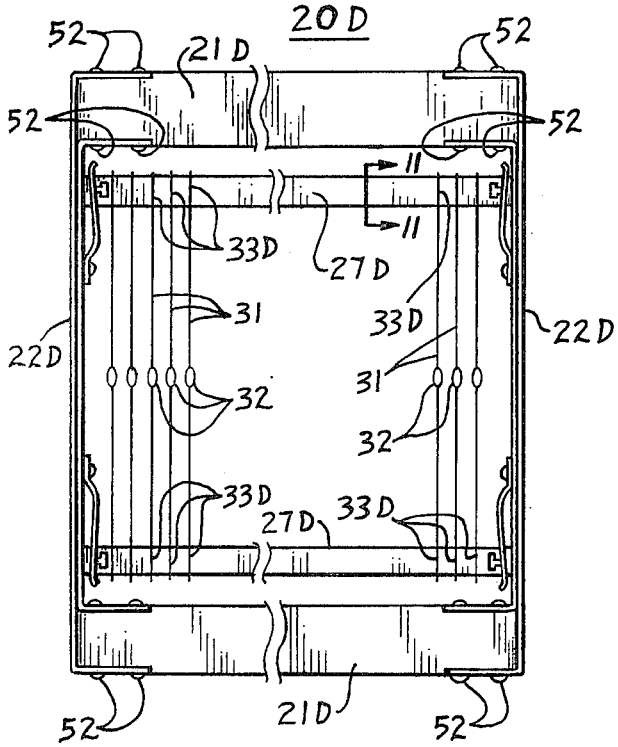
FIG. 10 is a front elevational view of a portion of another heddle frame having heddle rods in accordance with the invention incorporated therein.
Figure 11:
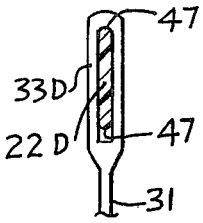
FIG. 11 is a fragmentary sectional view, enlarged, taken approximately on the line 11—11 of FIG. 10.
Figure 12:
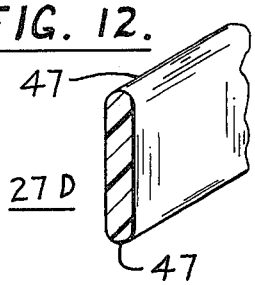
FIG. 12 is a fragmentary perspective view showing the heddle rods of FIGS. 10 and 11.

Referring now more particularly to FIGS. 10, 11, and 12 of the drawings, a heddle frame 20D is shown of well known construction comprising top and bottom rails 21D of wood and side struts 22D of metal connecting the ends of the rails 21D and maintaining them in spaced parallel relation. The side struts 22D can be held in engagement with the rails 21D in any desired manner, such as by screws 52.

The heddle frame 22D is shown as having mounted thereon upper and lower heddle supporting rods 27D and which are held in place by spring clips 29D engaging in T-shaped apertures 30D in the rods 27D. The heddle supporting rods 27D support a plurality of heddles 31 having central warp eyes 32 for controlling the shed and end eyes 33D of common and well known type.

The heddle supporting rods 27D are relatively short and are not supported intermediate their ends.

The heddle supporting rods 27D as illustrated in FIGS. 10, 11, and 12 are preferably made as extrusions and are generally rectangular in cross section with curved outer faces 47.

The rods 27D are preferably of synthetic plastic material which is resistant to impact, wear and abrasion and has a low coefficient of friction of the inner portions of the end eyes 33D, in engagement therewith during use.

Suitable materials include thermoplastics such as nylon, urethane and polyester.

In use, the heddles 31, at rest, are supported by the engagement of their upper end eyes 33 or 33D on the upwardly facing curved faces 47 on the upper and lower heddle rods 27, 27A, 27C, 27D. During vertical movement of the harness frame 20, 20A, 20C, 20D for shedding the load imparted by the warp to the warp eyes 32 will shift so that the heddles 31 engage at their upper and lower end eyes 33, 33D on the downwardly facing curved faces 47 of the upper and lower heddle rods 27, 27A, 27C, 27D.

The provision of the synthetic plastic faces 47 of the heddle rods 27, 27A, 27C, 27D is effective to provide satisfactory resistance to the impact of the heddles 31 on the heddle rods, to reduce the the wear and abrasive action of these parts and to reduce the noise level during operation while permitting free sidewise movement of the heddles 31 on the heddle rods 27, 27A, 27C, 27D.

I claim:

1. In a heddle frame having top and bottom rails, heddle supporting rods carried in said frame and heddles having end eyes carried on said rods, the improvement in said heddle supporting rods which comprises a central metallic rod portion having longitudinally extending non-metallic portions of less impact noise response in covering relation to the upper and lower edges of said metallic rod portion for contact with the interiors of said end eyes for reducing impact noise.

2. The combination defined in claim 1 in which said non-metallic portions are of synthetic plastic material.

3. The combination defined in claim 1 in which said central rod portion has longitudinally extending slots along top and bottom portions thereof, and said non-metallic portions are carried in said slots.

4. The combination defined in claim 3 in which said non-metallic portions are held in engagement in said slots.

5. The combination defined in claim 1 in which said non-metallic portions are held in engagement on said metallic rod portion.

* * * * *